US005410771A

United States Patent [19]

Bereza

[11] Patent Number: 5,410,771

[45] Date of Patent: May 2, 1995

[54] WINDOW WASHING TOOLS WITH VARIABLY POSITIONABLE HANDLES AND REMOVABLE WASHING SLEEVES

[76] Inventor: Michael I. Bereza, 6 Sarah La., Hopewell Junction, N.Y. 12533

[21] Appl. No.: 214,437

[22] Filed: Mar. 18, 1994

[51] Int. Cl.[6] ..... A47L 1/06

[52] U.S. Cl. ..... 15/220.1; 15/144.2; 15/232

[58] Field of Search ..... 15/144.2, 147.1, 220.1, 15/228, 231, 232; 403/87, 90

[56] References Cited

U.S. PATENT DOCUMENTS

| | | | |
|---|---|---|---|
| 869,842 | 10/1907 | Hill | 15/220.1 |
| 1,124,073 | 1/1915 | Sullivan | 15/144.2 |
| 1,470,014 | 10/1923 | Kootz | 15/228 |
| 3,214,779 | 11/1965 | Wheeler | 15/144.2 |
| 3,604,044 | 9/1971 | Johnson | 403/90 |

FOREIGN PATENT DOCUMENTS

| | | | |
|---|---|---|---|
| 692667 | 11/1930 | France | 403/90 |
| 926785 | 4/1947 | France | 15/231 |
| 940465 | 5/1948 | France | 15/144.1 |
| 0614552 | 6/1935 | Germany | 15/220.1 |
| 25613 | 1/1932 | Netherlands | 15/231 |
| 28299 | of 1907 | United Kingdom | 15/232 |
| 331623 | 7/1930 | United Kingdom | 15/228 |

*Primary Examiner*—David A. Scherbel
*Assistant Examiner*—Randall E. Chin

[57] ABSTRACT

A window washing tool with variably positionable handles and removable washing sleeves comprising a head formed with a generally rectangular block having a front face, a rear face, front and rear edges and side edges therebetween, the head being formed with a plurality of centrally disposed apertures and four attachment apertures spaced laterally from the central apertures. A central plate formed with a planar lower section with a plurality of apertures and positionable on the upper rear face of the head with the apertures of the head in alignment of the apertures of the plate, the plate having an upstanding ball. Coupling bolts with associated nuts for releasably coupling the plate to the head. A pair of support sheets each with a pair of apertures extending therethrough, the support sheets being formed with a curved configuration and positionable over the sides of the head with the apertures of the sheets in alignment with the laterally disposed apertures of the head. A plurality of bolts with associated wing nuts positionable through the apertures on the opposite sides of the center of the head for coupling the sheets to the rear face of the head and a coupling component with a generally hemispherical recess adapted to receive the ball of the plate and with a threaded aperture extending through the coupling component and with a wing nut releasably secured therethrough for rigidly securing the coupling component with respect to the ball during operation and use, the coupling component including a threaded recess threads extending through a lateral face thereof.

4 Claims, 4 Drawing Sheets

WINDOW WASHING TOOLS WITH VARIABLY POSITIONABLE HANDLES AND REMOVABLE WASHING SLEEVES

BACKGROUND OF THE INVENTION

1. Field of the Invention

The present invention relates to window washing tools with variably positionable handles and removable washing sleeves and more particularly pertains to washing windows with an improved tool allowing for adjustment of the head with respect to the handle and permitting the replacement of a washing sleeve.

2. Description of the Prior Art

The use of window washing devices is known in the prior art. More specifically, window washing devices heretofore devised and utilized for the purpose of washing devices with hand held tools are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,461,476 to North a window washing apparatus.

U.S. Pat. No. 3,769,651 to Sunkes disclosure of an adjustable window cleaning device for washing and drying both window surfaces from within the room.

U.S. Pat. No. 3,783,469 to Siemund discloses a combination window washer, scraper and squeegee.

U.S. Pat. Des. No. 294,989 to Jinkins discloses the design of a manual window washer device.

U.S. Pat. Des. No. 320,490 to Andrew, III et al. discloses the design of a window washing device.

In this respect, the window washing tools with variably positionable handles and removable washing sleeves according to the present invention substantially departs from the conventional concepts and designs of the prior art, and in doing so provides an apparatus primarily developed for the purpose of washing windows with an improved tool allowing for adjustment of the hand with respect to the handle and permitting the replacement of a washing sleeve.

Therefore, it can be appreciated that there exists a continuing need for new and improved window washing tools with variably positionable handles and removable washing sleeves which can be used for washing windows with an improved tool allowing for adjustment of the hand with respect to the handle and permitting the replacement of a washing sleeve. In this regard, the present invention substantially fulfills this need.

SUMMARY OF THE INVENTION

In view of the foregoing disadvantages inherent in the known types of window washing devices now present in the prior art, the present invention provides an improved window washing tools with variably positionable handles and removable washing sleeves. As such, the general purpose of the present invention, which will be described subsequently in greater detail, is to provide a new and improved window washing tools with variably positionable handles and removable washing sleeves and method which has all the advantages of the prior art and none of the disadvantages.

To attain this, the present invention essentially comprises of a new and improved window washing tool with a variably positionable handle and a removable washing sleeve comprising of a head formed with a generally rectangular block having a front face, a rear face, front and rear edges and side edges therebetween, the head being formed with a plurality of centrally disposed apertures and four attachment apertures spaced laterally from the central apertures. A central plate formed with a planar lower section with a plurality of apertures and positionable on the upper rear face of the head with the apertures of the head in alignment with the apertures of the plate, the plate having an upstanding ball. Coupling bolts with associated nuts for releasably coupling the plate to the head. A pair of support sheets each with a pair of apertures extending therethrough, the support sheets being formed with a curved configuration and positionable over the sides of the head with the apertures of the sheets in alignment with the laterally disposed apertures of the head. A plurality of bolts with associated wing nuts positionable through the apertures on the opposite sides of the center of the head for coupling the sheets to the rear face of the head. A replaceable sleeve, the replaceable sleeve being in a generally rectangular configuration with long front and rear walls and short sidewalls therebetween, the front and rear walls being formed with inwardly extending recesses extending from the edges thereof, the regions of the sleeve laterally remote from the recesses being positionable between the rear face of the head and the sheets with the central region of the sleeve located over the front and rear faces of the block. A coupling component with a generally hemispherical recess adapted to receive the ball of the plate and with a threaded aperture extending through the coupling component and with a wing nut releasably secured therethrough for rigidly securing the coupling component with respect to the ball during operation and use, the coupling component including a threaded recess extending through a lateral face thereof. A handle having a threaded upper end adapted to be releasably received by the threaded recess in the coupling component.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved window washing tools with variably positionable handles and removable washing sleeves which have all the advantages of the prior art window washing devices and none of the disadvantages.

It is another object of the present invention to provide new and improved window washing tools with variably positionable handles and removable washing sleeves which may be easily and efficiently manufactured and marketed.

It is further object of the present invention to provide new and improved window washing tools with variably positionable handles and removable washing sleeves which are of durable and reliable constructions.

An even further object of the present invention is to provide new and improved window washing tools with variably positionable handles and removable washing sleeves which are susceptible of a low cost of manufacture with regard to both materials and labor, and which accordingly are then susceptible of low prices of sale to the consuming public, thereby making such window washing tools with variably positionable handles and removable washing sleeves economically available to the buying public.

Still yet another object of the present invention is to provide new and improved window washing tools with variably positionable handles and removable washing sleeves which provide in the apparatuses and methods of the prior art some of the advantages thereof, while simultaneously overcoming some of the disadvantages normally associated therewith.

Still another object of the present invention is for washing windows with an improved tool allowing for adjustment of the hand with respect to the handle and permitting the replacement of a washing sleeve.

Lastly, it is an object of the present invention to provide new and improved window washing tool with variably positionable handles and removable washing sleeves comprising of a head formed with a generally rectangular block having a front face, a rear face, front and rear edges and side edges therebetween, the head being formed with a plurality of centrally disposed apertures and a pair of attachment apertures spaced laterally from the central apertures. A central plate formed with a planar lower section with a plurality of apertures and positionable on the upper rear face of the head with the apertures of the head in alignment of the apertures of the plate, the plate having an upstanding ball. Coupling bolts with associated nuts for releasably coupling the plate to the head. A pair of support sheets each with a pair of apertures extending therethrough, the support sheets being formed with a curved configuration and positionable over the sides of the head with the apertures of the sheets in alignment with the laterally disposed apertures of the head. A plurality of bolts with associated wing nuts positionable through the apertures on the opposite sides of the center of the head for coupling the sheets to the rear face of the head and a coupling component with a generally hemispherical recess adapted to receive the ball of the block and with a threaded aperture extending through the coupling component and with a wing nut releasably secured therethrough for rigidly securing the coupling component with respect to the ball during operation and use, the coupling component including a threaded recess threads extending through a lateral face thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
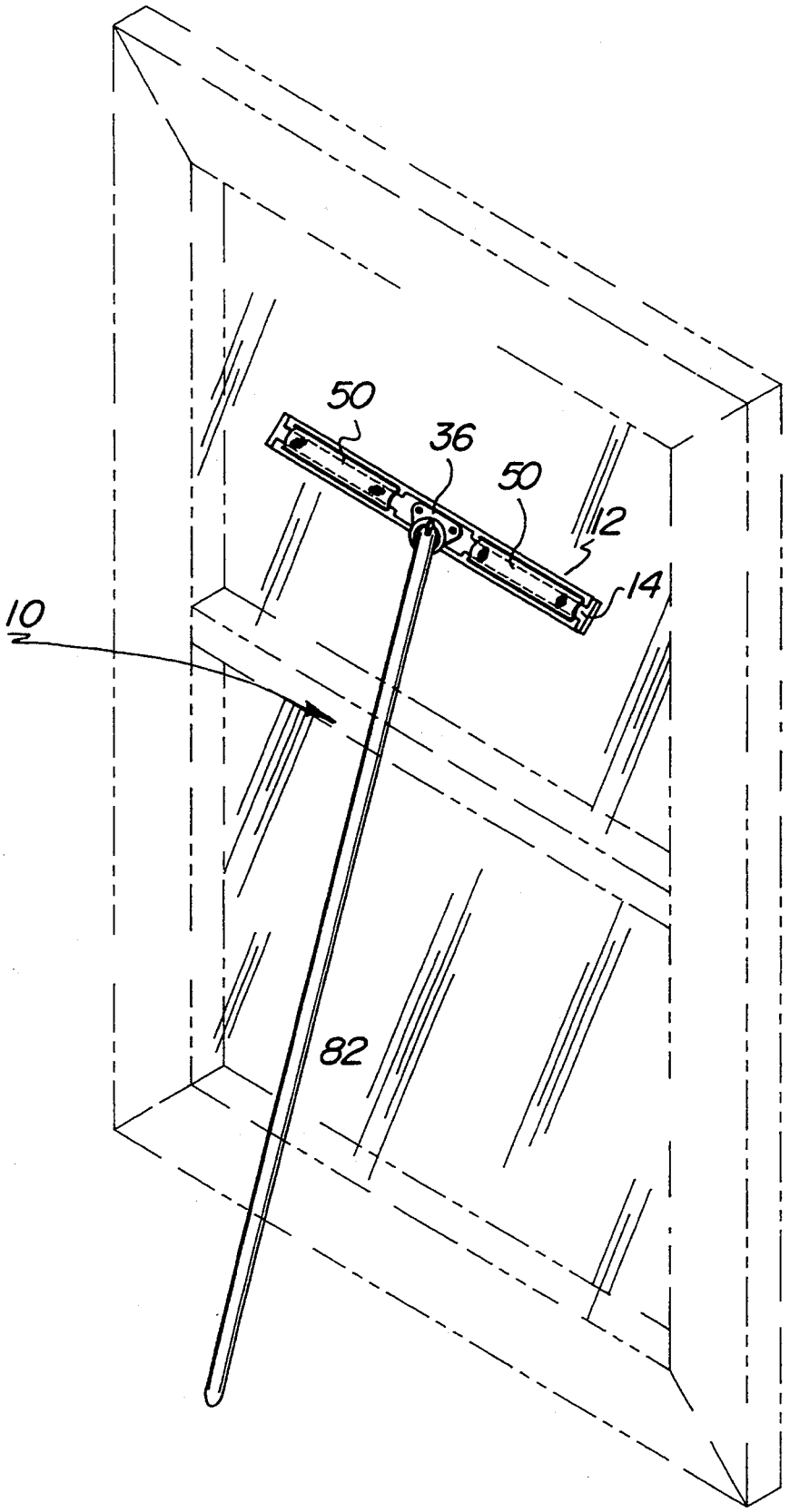
FIG. 1 is a perspective illustration of the preferred embodiment of the new and improved window washing tools with variably positionable handles and removable washing sleeves constructed in accordance with the principles of the present invention.
Figure 2:
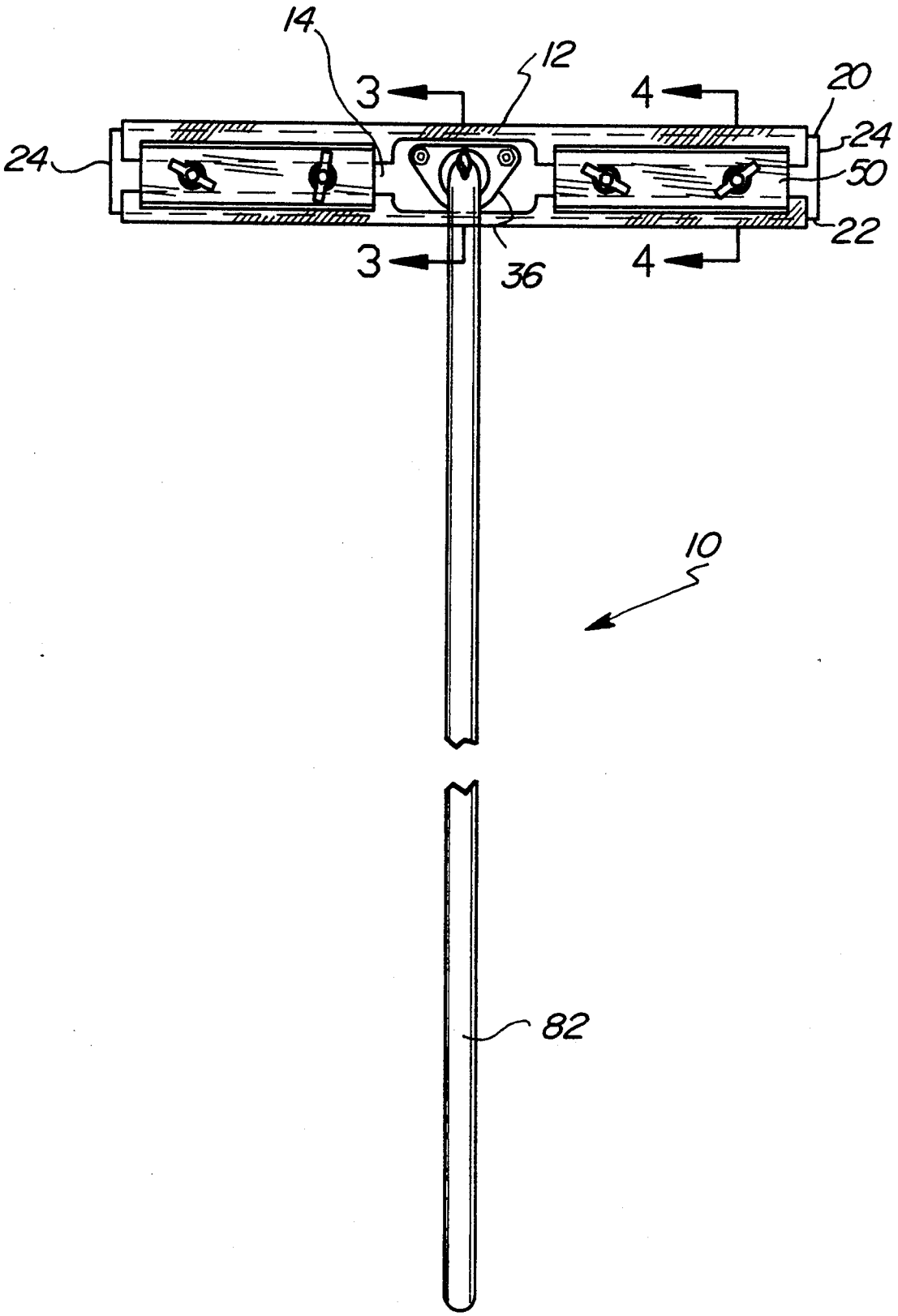
FIG. 2 is a front elevational view of the tool shown in FIG. 1.
Figure 4:
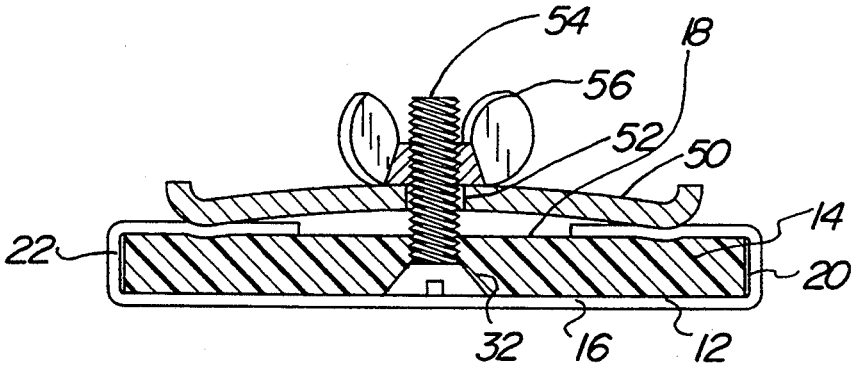
FIG. 4 is a cross-sectional view taken along line 4—4 of FIG. 2.
Figure 3:
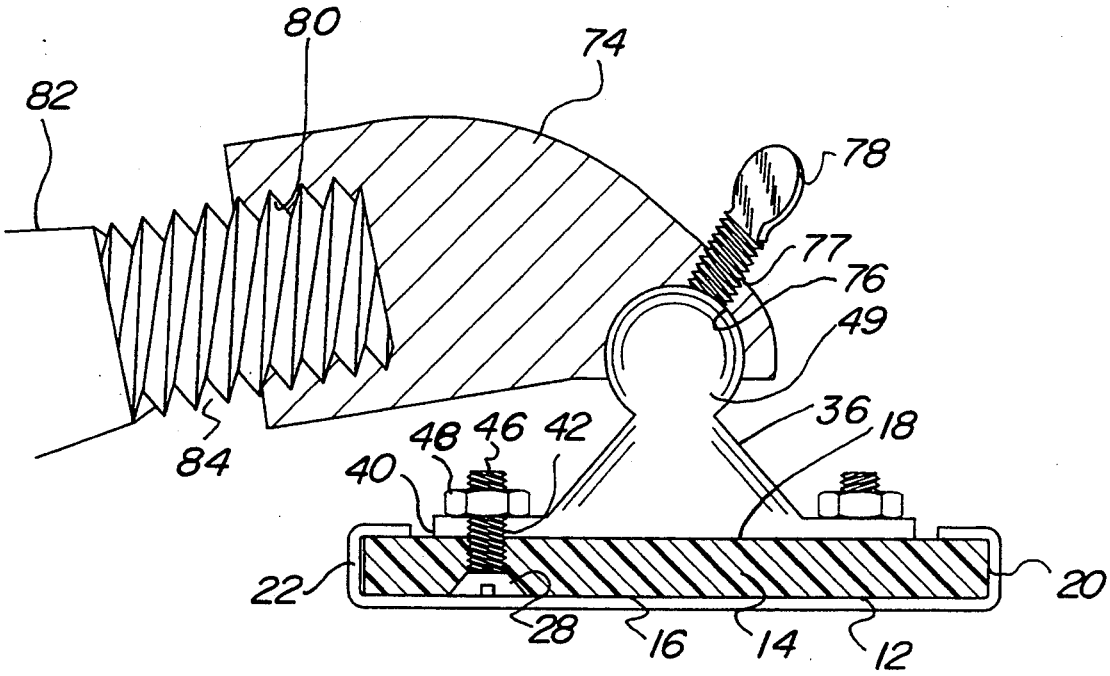
FIG. 3 is a cross-sectional view taken along line 3—3 of FIG. 2.
Figure 5:
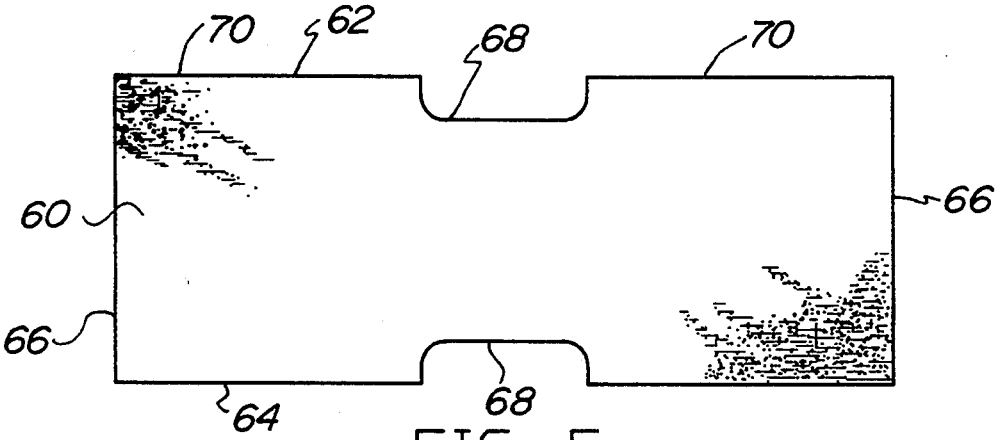
FIG. 5 is a plan view of the replaceable sleeve employed with the device of the prior Figures.
Figure 6:
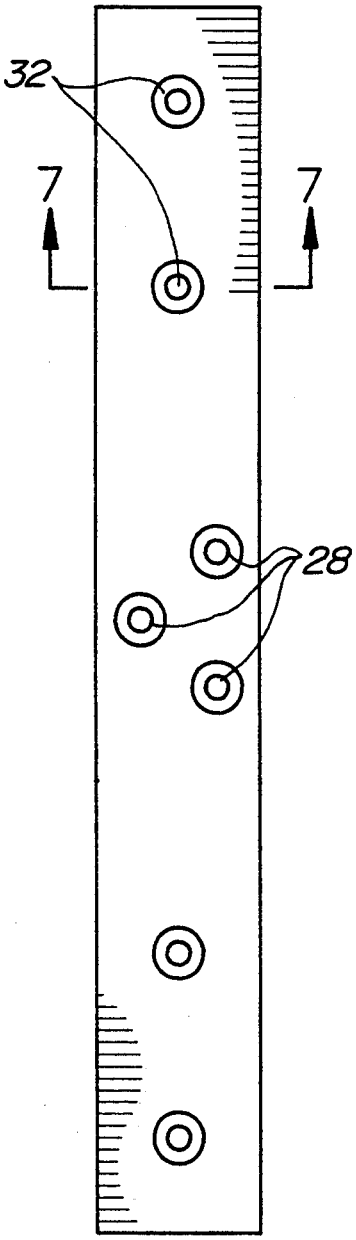
FIG. 6 is a plan view of the head of the device shown in the prior Figures.
Figure 7:
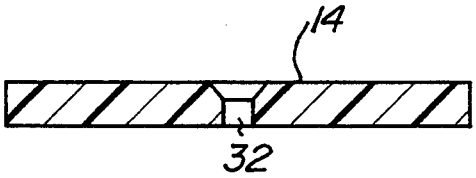
FIG. 7 is a cross-sectional view of the head taken along lines 7—7 of FIG. 6.
Figure 9:
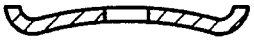
FIG. 9 is a cross-sectional view taken along line 9—9 of FIG. 8.
Figure 8:
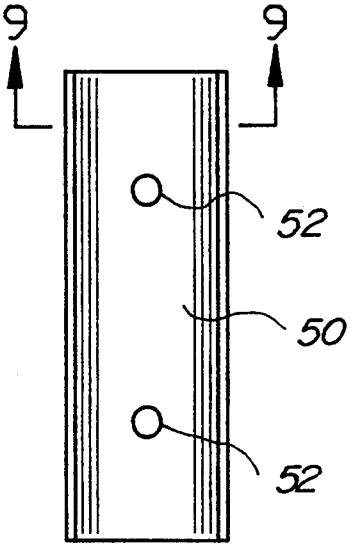
FIG. 8 is a plan view of one of the head supports shown in the prior Figures.

With reference now to the drawings, and in particular to FIG. 1 thereof, the preferred embodiment of the new and improved window washing tools with variably positionable handles and removable washing sleeves embodying the principles and concepts of the present invention and generally designated by the reference numeral 10 will be described.

The present invention, a new and improved window washing tool with variably positionable handles and removable washing sleeves is comprised of a plurality of individual components. In their broadest context, such components include a head, a central plate, coupling bolts, support sheets, additional bolts, a replaceable sleeve, coupling components and a handle. Such components are individually and correlated with respect to each other so as to attain the desired objectives.

More specifically, the central component of the invention is a head 12. The head is formed with a generally rectangular block 14. The block has a front face 16 and a rear face 18. Front 20 and rear edges 22 are also provided with sides edges 24 coupled therebetween. The head is formed with a plurality of centrally disposed apertures 28 and a pair of attachment apertures 32 spaced laterally from the central apertures on both sides thereof.

Next provided is a central plate 36. Such plate is formed with a planar lower section 40. The plate has a plurality of apertures therethrough. Such plate is positionable on the upper rear surface of the head with the apertures of the head in alignment with the apertures of the plate. On the opposite face thereof, the plate has an upstanding ball 49.

Coupling bolts 46 are also provided. Associated nuts 48 are removably coupled with respect to such bolts. The nuts and bolts together are for releasably coupling the plate to the head.

Next provided are a pair of support sheets 50. Each such sheet is provided with a pair of apertures 52 extending therethrough. The support sheets are formed with a curved configuration and they are positionable over the sides of the head. The apertures of the sheets 50 are positioned in alignment with the laterally disposed apertures of the head for mutual coupling therebetween. A plurality of supplemental bolts 54 are also provided with associated wing nuts 56. Such bolts are positionable through the apertures on the opposite sides of the center of the head. This is for coupling the sheets to the rear face of the head.

A replaceable sleeve 60 is next provided. Such sleeve is in a generally rectangular configuration. It has long front and rear walls 62 and 64. It also has short walls 66 between the front and rear walls. The front and rear walls are formed with inwardly extending recesses 68. Such recesses extend from the edges thereof. The regions 70 of the sleeve laterally remote from the recesses are positionable between the rear face of the head and the sheets. The central region of the sleeve is located over the front and rear faces of the block.

For interconnecting the head and its associated components with a handle, a coupling component 74 is next provided. Such coupling component is formed with a generally hemispherical recess 76. Such recess is adapted to receive the ball of the plate. A threaded aperture 77 extends through the coupling component. A wing nut 78 is releasably secured through the aperture 77 which, when tightened down, will rigidly secure the coupling component with respect to the ball during operation and use. The coupling component also includes a threaded recess 80. Such recess extends into a lateral face of the coupling component for receiving the handle.

The last component of the system is the handle 82. Such handle is an elongated cylindrical member adapted to be held by the user of the device. The handle 82 had a threaded upper end 84. Such threaded upper end is adapted to be releasably received by the threaded recess 80 in the coupling component. When the handle is secured to the coupling component, the coupling component secured to the head and the sleeve on the head, the system is ready for operation and uses.

Window washing tools with variably positionable handles and removable washing sleeves is a new, more effective type of washer wand for use in cleaning windows. Conventional washer wands are cylindrical, with roughly a one-inch diameter. Various sleeves used in the cleaning process can then be slipped over the wand. These wands do an adequate job; however, window washing tools with variably positionable handles and removable washing sleeves does an even better one.

In contrast to the cylindrical shape of conventional wands, window washing tools with variably positionable handles and removable washing sleeves features a flat piece of plastic measuring 18 inches by $1\frac{3}{8}$ inches by $\frac{1}{4}$ inches. This piece of plastic is bolted on to a pivoting or standard squeegee handle, suitably modified for this new type of wand. The plastic piece is then covered by a fabric sleeve.

The advantage of window washing tools with variably positionable handles and removable washing sleeves are as follows: First of all, it can cover a larger area with each pass than the conventional washer wand, thereby increasing productivity. Areas that are difficult to reach, such as behind window shades, are easier to clean with this new product. In addition, window washing tools with variably positionable handles and removable washing sleeves makes less of a mess on the side frames of windows, and cleanup of water on the bottom frame is faster. These factors all bode well for the commercial viability of this product.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved window washing tool with a variable positionable handle and a removable washing sleeve comprising, in combination:

a head formed in a generally rectangular configuration having a front face, a rear face, front and rear edges and side edges with a center therebetween, the head being formed with a plurality of centrally disposed apertures and a pair of attachment apertures spaced laterally on each side of the centrally disposed apertures;

a central plate formed with a planar lower section with a plurality of apertures and positionable on the rear face of the head with the centrally disposed apertures of the head in alignment with the apertures of the plate, the plate having an upstanding ball;

coupling bolts with associated nuts for releasably coupling the plate to the head;

a pair of support sheets each with a pair of apertures extending therethrough, each support sheet being formed with a curved configuration and positionable over the head with the apertures of each sheet in alignment with the respective pair of attachment apertures on the opposite sides of the center of the head;

a plurality of bolts with associated wing nuts positionable through the attachment apertures on the opposite sides of the center of the head for coupling the sheets to the rear face of the head;

a replaceable sleeve, the replaceable sleeve being in a generally rectangular configuration with front and rear walls and sidewalls therebetween, the front and rear walls being formed with an inwardly extending recess, the regions of the sleeve laterally remote from the recesses being positionable between the rear face of the head and the sheets with a portion of the sleeve located over the front and rear faces of the block; and a coupling component with a generally hemispherical recess adapted to receive the ball of the plate and an associated threaded aperture extending through the coupling component and a wing nut releasably secured therethrough for rigidly securing the coupling component with respect to the ball during operation and use, the coupling component further including a threaded recess extending through a lateral face thereof; and a handle having a threaded upper end adapted to be releasably received by the threaded recess in the coupling component.

2. A window washing tool comprising:

a head formed in a generally rectangular configuration having a front face, a rear face, front and rear edges and side edges with a center therebetween, the head being formed with a plurality of centrally disposed apertures and a pair of attachment apertures spaced laterally on each side of the centrally disposed apertures;

a central plate formed with a planar lower section with a plurality of apertures and positionable on the rear face of the head with the centrally disposed apertures of the head in alignment with the apertures of the plate, the plate having an upstanding ball;

coupling bolts with associated nuts for releasably coupling the plate to the head;

a pair of support sheets each with a pair of apertures extending therethrough, each support sheet being formed with a curved configuration and positionable over the head with the apertures of each sheet in alignment with the respective pair of attachment apertures on the opposite sides of the center of the head for attaching a removable washing sleeve;

a plurality of bolts with associated wing nuts positionable through the attachment apertures on the opposite sides of the center of the head for coupling the sheets to the rear face of the head; and a coupling component with a generally hemispherical recess adapted to receive the ball of the plate and an associated threaded aperture extending through the coupling component and a wing nut releasably secured therethrough for rigidly securing the coupling component with respect to the ball during operation and use, the coupling component further including a threaded recess extending through a lateral face thereof for receiving a variable positionable handle.

3. The tool as set forth in claim 2 and further including:

a handle having a threaded upper end adapted to be releasably received by the threaded recess in the coupling component.

4. The tool as set forth in claim 2 and further including:

a replaceable sleeve, the replaceable sleeve being in a generally rectangular configuration with front and rear walls and sidewalls therebetween, the front and rear walls being formed with an inwardly extending recess, the regions of the sleeve laterally remote from the recesses being positionable between the rear face of the head and the sheets with a portion of the sleeve located over the front and rear faces of the block.

* * * * *